US008505428B2

(12) United States Patent
Overstreet et al.

(10) Patent No.: US 8,505,428 B2
(45) Date of Patent: Aug. 13, 2013

(54) ANTI JAM, GROOVED AND EXPANDING CHARGING HANDLE FOR SUB CALIBER ACTIONS

(75) Inventors: John L. Overstreet, Fayette, MO (US); Jordan Bowles, Columbia, MO (US)

(73) Assignee: 22 Evolution LLC, Columbia, MO (US)

( * ) Notice: Subject to any disclaimer, the term of this patent is extended or adjusted under 35 U.S.C. 154(b) by 148 days.

(21) Appl. No.: 13/096,065

(22) Filed: Apr. 28, 2011

(65) Prior Publication Data

US 2011/0265636 A1 Nov. 3, 2011

Related U.S. Application Data

(60) Provisional application No. 61/328,788, filed on Apr. 28, 2010.

(51) Int. Cl.
*F41A 19/34* (2006.01)

(52) U.S. Cl.
USPC ..... 89/1.4

(58) Field of Classification Search
USPC ..... 89/1.4, 191.01; 42/16; D22/108
See application file for complete search history.

(56) References Cited

U.S. PATENT DOCUMENTS

| | | | | |
|---|---|---|---|---|
| 3,225,653 | A * | 12/1965 | Packard | 89/1.4 |
| 6,311,603 | B1 | 11/2001 | Dunlap | |
| 7,231,861 | B1 | 6/2007 | Gauny et al. | |
| 7,240,600 | B1 | 7/2007 | Bordson | |
| D614,718 | S | 4/2010 | Hoel | |
| 7,707,921 | B1 | 5/2010 | Hoel | |
| 7,798,045 | B1 | 9/2010 | Fitzpatrick et al. | |
| 7,861,635 | B1 * | 1/2011 | Hoel | 89/1.4 |
| 7,900,546 | B2 * | 3/2011 | Bordson | 89/1.4 |
| 8,176,827 | B2 * | 5/2012 | Emde | 89/1.4 |

FOREIGN PATENT DOCUMENTS

RU 2329449 C1 7/2008

* cited by examiner

*Primary Examiner* — Bret Hayes
(74) *Attorney, Agent, or Firm* — Gifford, Krass, Sprinkle, Anderson & Citkowski, P.C.; Douglas J. McEvoy

(57) ABSTRACT

A telescopic charging handle incorporated into an upper receiver of an AR-15 type firearm includes a first stem portion integrally formed with a handle shaped head. A second stem portion terminates at a distal end in a projecting beak and is further telescopically engaged at a proximal end to the first stem portion. In this fashion, the charging handle is extended upon being rearwardly displaced in order to accommodate a modified length sub caliber action.

11 Claims, 6 Drawing Sheets

ANTI JAM, GROOVED AND EXPANDING CHARGING HANDLE FOR SUB CALIBER ACTIONS

CROSS-REFERENCE TO RELATED APPLICATIONS

This Application claims the benefit of U.S. Provisional Application 61/328,788 filed on Apr. 28, 2010.

FIELD OF THE INVENTION

The present invention discloses an anti-jam provision incorporated into an upper receiver charging handle which is grooved along its shaft underside for preventing such as .22 caliber casings from becoming lodged. A further design of the charging handle is configured with first and second telescoping portions in order to provide ease of installation into the rear of the upper receiver as well as to provide the ability to expand the overall handle length in order to simulate a full length of pull as provided in a centerfire counter-part. The expandable feature associated with the charging handle allows for installation of the sub caliber action with the charging handle in an initially fully closed (collapsed) position. This is further made possible by the shallow channel incorporated into the stem underside and extending all of the way to the rear of the charging handle (this in contrast to standard handle designs in which resultant interference prevents installation).

BACKGROUND OF THE INVENTION

A known problem associated with rim fire ammunition used in AR15/M16 style firearms involves the spent casings becoming lodged within the upper receiver channels. Existing one piece charging handles further tend to not be fully closable when employed with modified action assemblies (receiver plate, reciprocating bolt, forward chamber adapter) installed within the upper receiver for receiving such as sub-caliber (e.g. rimfire) ammunition. Such existing charging handles tend only to retract rearwardly approximately half an extracting distance, such as required for removal of the action assembly, and in comparison to a range of motion associated with original manufacturer specified action assemblies such as employed with center fire cartridges.

SUMMARY OF THE INVENTION

The present invention discloses a telescopic charging handle incorporated into an upper receiver of an AR-15 type firearm includes a first stem portion integrally formed with a handle shaped head. A second stem portion terminates at a distal end in a projecting beak and is further telescopically engaged at a proximal end to the first stem portion. In this fashion, the charging handle is extended upon being rearwardly displaced in order to accommodate a modified length sub caliber action.

Additional features include a pair of linear extending slots extending a given distance along said first stem. The second stem further includes a reduced dimension portion which is sized to seat within a communicating distal and interiorly open end of the first stem portion. A distal end located and widthwise extending aperture in the second telescoping stem portion aligns with the slots in the first stem portion and, upon insertion of a widthwise pin, is telescopically mounted between the fully collapsed and extended positions.

Other features include the second telescoping stem portion exhibiting an underside extending and sub caliber action engaging beak. A pair of wing projections extend in opposite fashion from a distal end of the second stem portion.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
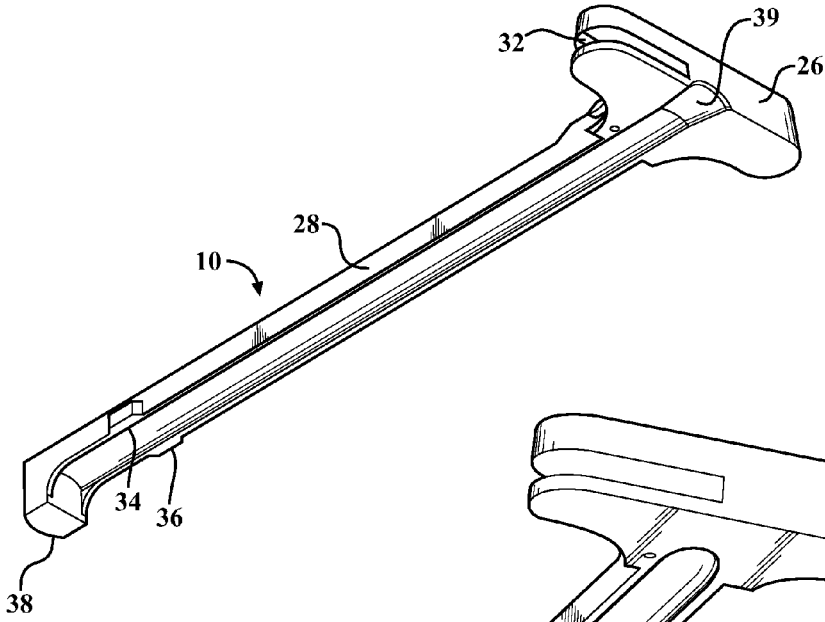
FIG. 1 is a perspective illustration of a charging handle according to one embodiment of the invention.

As illustrated with reference to the succeeding illustrations, the present invention discloses an anti-jam provision incorporated into an upper receiver charging handle 10 forming a part in an AR-15 upper receiver. The charging handle, as further illustrated in the environmental views of FIGS. 5-7 in reference to an upper receiver 12, is seated within a rear open end 14 of the receiver 12 in order to support and secure an associated and reciprocating bolt 15 supported sub caliber action (see as illustrated in an intermediate installed position in FIG. 5 with further projecting end receiver plate 16 for seating the bolt 15 within a notch defined interior in order to facilitate reciprocating cycling of the bolt during successive cartridge discharge). The receiver plate 16 and bolt 15 are not shown in FIGS. 6 and 7 for purposes of ease of illustration and so as to better illustrate the individual installation of the charging handle to the rear of the upper receiver.

Figure 5:
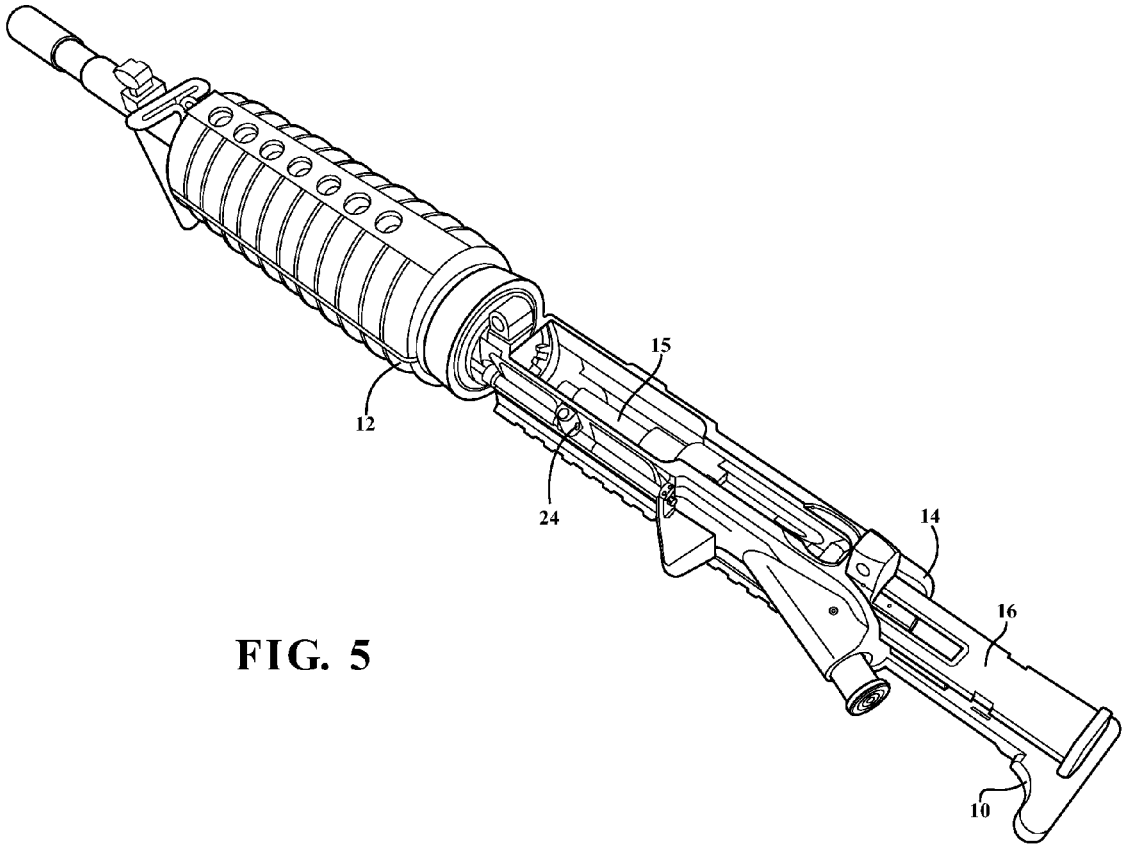
FIGS. 5-7 are a series of illustrations of an upper AR-15 receiver and depicting the manner in which the charging handle is mounted to the rear of the receiver in cooperation with the bolt.
Figure 6:
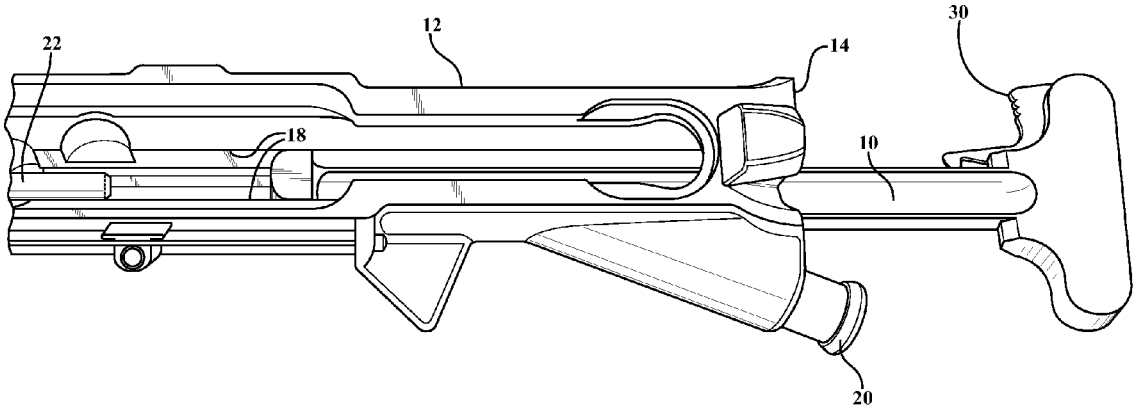
Figure 7:
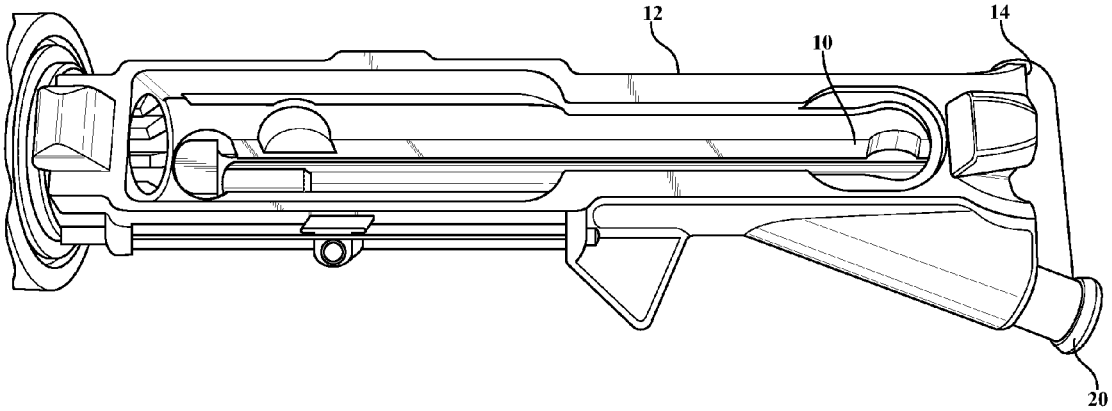

As further shown in FIG. 6, the underside accessible location of the upper receiver 12, this corresponding to where the magazine supplied cartridges associated with the lower attachable receiver (not shown) are successively loaded into the barrel in front of the bolt 15 as shown in FIG. 5, reveals a pair of side rails 18 which support a stem portion of the charging handle between an initial loading position (again FIG. 5) and a substantially installed position (FIG. 7), concurrent with the separate assembly of the bolt (again FIG. 5).

Figure 8:
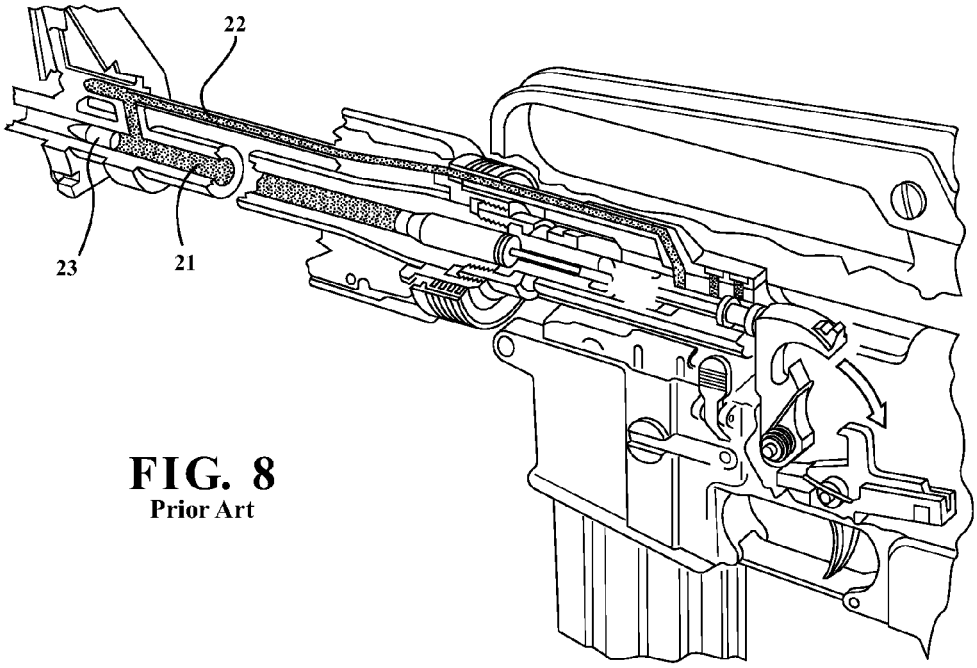
FIG. 8 Prior Art
FIG. 8 is a Prior Art depiction of an operating mechanism associated with an AR-15 rifle.

FIG. 6 also shows the forward assist 20 and gas tube 22 components associated with the upper receiver 12. As is known from reference to the prior art view of FIG. 8, the operating principle of the AR-15 rifle includes gas being tapped from barrel 21 as a fired bullet 23 moves past a gas port located above the rifle's front sight base. The gas rushes into the port and down a gas tube, located above the barrel, which runs from the front sight base into the AR-15's upper receiver.

Here, the gas tube protrudes into a "gas key" (bolt carrier key) which accepts the gas and funnels it into the bolt carrier.

The bolt and bolt carrier together form a piston, which is caused to expand as the cavity in the bolt carrier fills with high pressure gas. The bolt is locked into the barrel extension, such that this expansion forces the bolt carrier backward in line with the stock of the rifle.

As the bolt carrier moves toward the butt of the gun, the bolt cam pin, riding in a slot on the bolt carrier, forces the bolt to turn and unlock from the barrel extension. Once the bolt is fully unlocked, it begins its rearward movement along with the bolt carrier. The bolt's rearward motion extracts the empty cartridge case from the chamber, and as soon as the neck of the case clears the barrel extension, the bolt's spring-loaded ejector forces it out the ejection port (see also at 24 in FIG. 5) configured in the side of the upper receiver.

The charging handle 10 (as further depicted in FIGS. 1-3) is a device on a firearm which, when operated, results in the hammer or striker (not shown) being cocked or moved to the ready position. It allows the operator to pull the bolt 15 to the rear, facilitating any number of functions including ejecting a spent shell casing or unfired cartridge from the chamber, loading a round from the magazine or by hand through the chamber, clearing a stoppage such as a jam, double feed, stovepipe or misfire, verification that the weapon's chamber is clear of any rounds or other obstructions or releasing a bolt locked to the rear, such as would be the case after firing the last round on a firearm equipped with a last-round-hold-open feature.

Figure 2:
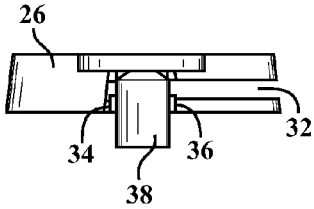
FIG. 2 is a front view of the handle shown in FIG. 1.
Figure 3:
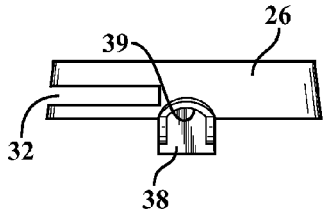
FIG. 3 is a rear view of the handle.

Referring again collectively to the charging handle 10 of FIGS. 1-3, included is an enlarged head shaped housing 26 and integrally formed stem 28. A latch illustrated at 30 in FIG. 6 is supported within a seating aperture 32 (FIG. 1) configured within the charging handle head 26 and biased or loaded in a forward direction via a coil spring (also not shown) disposed therebetween.

Lateral (or wing) projections 34 and 36 (see as best shown in FIGS. 1 and 2) established at a substantially distal end of the stem 28 and seat within mating recess configured locations in the rails 18 (again FIG. 6) located within the upper receiver 12. The conventional charging handle of FIGS. 1-3 exhibits an underside extending and distal end beak 38 which, upon rearwardly displacing the charging handle, engages an upper location of the spring displaceable bolt 15 (as best approximated in the partially dissembled view of FIG. 5).

Figure 1A:
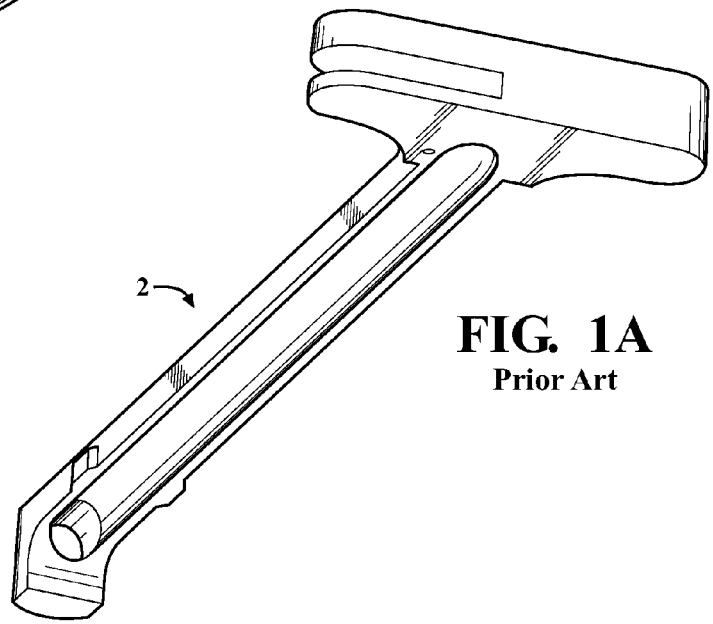
FIG. 1A Prior Art
FIG. 1A is a perspective illustration of a charging handle according to the Prior Art in comparison to that depicted in FIG. 1.

A unique feature associated with the charging handle is the configuration of the shallower channel configuration of the stem underside, see at 39 in FIG. 1 as well as in the rear end view of FIG. 3, which is in contrast to that depicted in the Prior Art charging handle 2 in FIG. 1A which does not incorporate a channel present at the rear thereof and which, as a consequence of use, results in such as .22 caliber casings becoming lodged or stuck. In contrast, the reduced (shallower) arcuate recess profile or dimension of the stem underside 39 of handle 10 shown in FIG. 1 is such that it largely prevents the lodging of .22 casings.

Figure 4A:
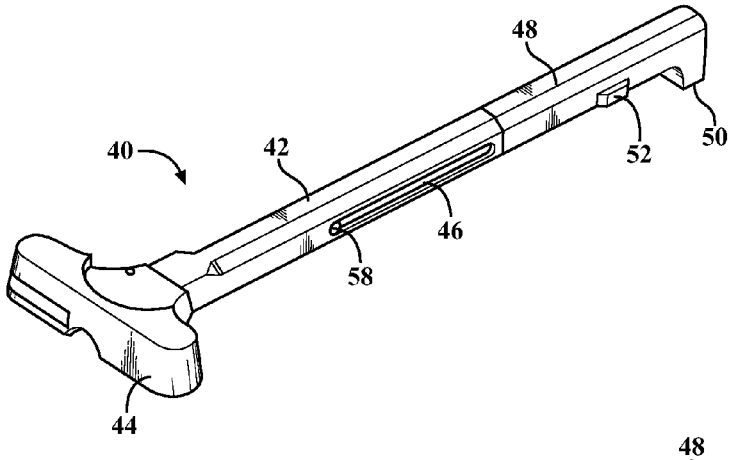
FIGS. 4A-4C are a succession of rotated perspectives of a telescoping charging handle in assembled (retracted), assembled (extended) and exploded fashion according to the present invention.
Figure 4B:
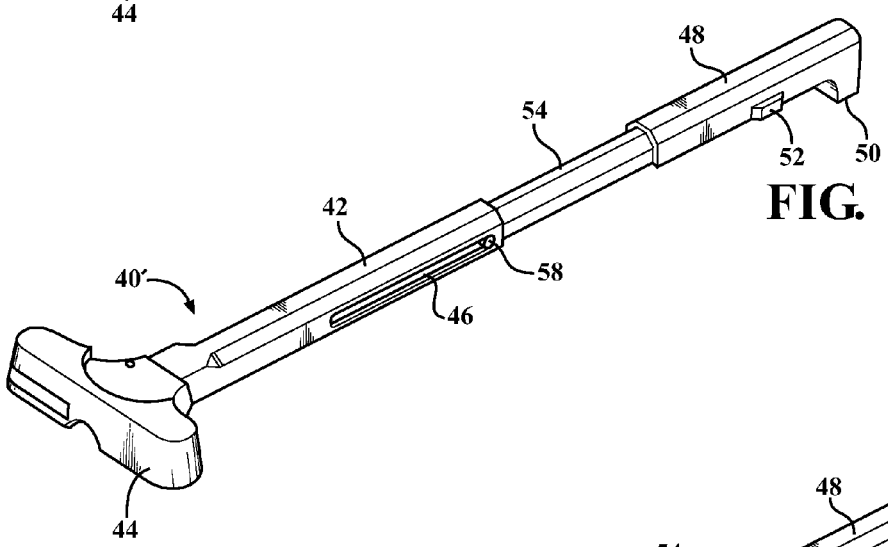
Figure 4C:
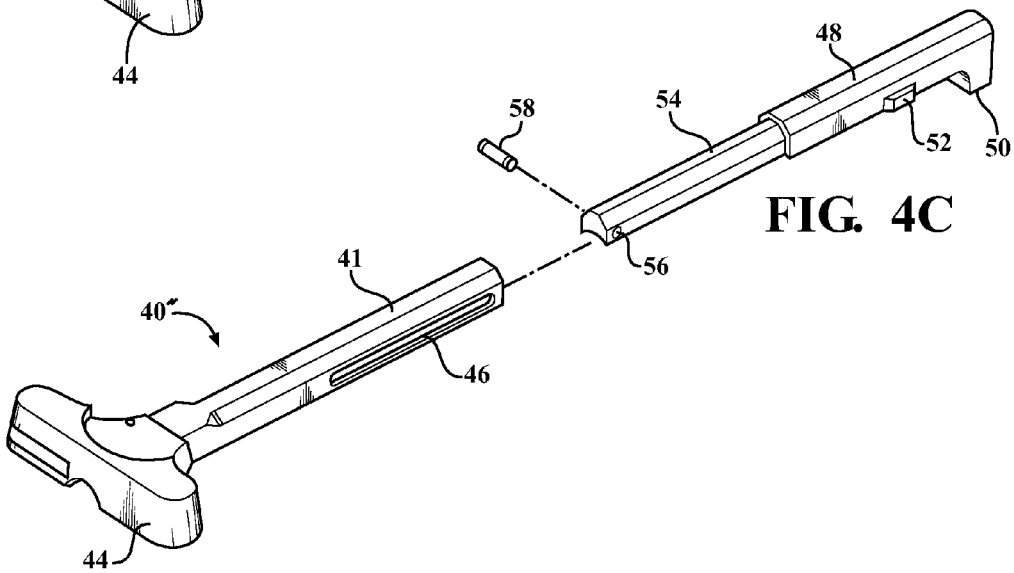

Referring finally to FIGS. 4A-4C, illustrated respectively are a succession of rotated perspectives of a telescopically configured charging handle in assembled/retracted 40, assembled/extended 40' and exploded 40" fashion. Of notable difference in comparison to the handle design of FIG. 1, the charging handle incorporates a first stem portion 42 integrally formed with a handle shaped head (further shown at 44 and otherwise identical to that previously described at 26 in FIG. 1).

A pair of linear extending slots (of which one is shown at 46 in each of FIGS. 4A-4C) extends a given distance along the stem portion 42 to a generally distal end. A second stem portion 48 is provided and exhibits a main body terminating in an underside and bolt engaging beak 50. As with the handle 10 in FIG. 1, a pair of wing projections (see as shown at 52) extend in opposite fashion from a distal end of the stem portion 42.

The second stem portion 48 further exhibits an integrally and reduced dimension portion 54 at a proximal end and which is sized to seat within a communicating distal and interiorly open distal end of the first stem portion 42. A distal end located and widthwise extending aperture 56 (FIG. 4C) in the second telescoping stem portion aligns with the slots 46 and, upon insertion of a widthwise extending pin 58 (again FIG. 4C), the stem portions 42 and 48 are telescopically mounted between the fully collapsed position of FIG. 4A and fully extended position of FIG. 4B.

In operation, charging handle 40 provides ease of installation into the rear of the upper receiver, as well as to provide the ability to expand the overall handle length in order to simulate a full length of pull as required in a centerfire counter-part, this in addition to providing anti-jam protection for sub-caliber actions. As is also known, spent rim fire casings can become lodged within a standard charging handle (again FIG. 1), and which further cannot be fully closed when installing such sub caliber actions (e.g. including bolt 14 and end receiver plate 16).

In such instances, a conventional charging handle 2 is capable of retraction to only about one half of the required distance in a center fire application. This is overcome by the telescoping charging handle design in which the fully extended position of the handle (again at 40' in FIG. 4B) provides the necessary extension in stem length, while collapsing to the conventional length dimension 40 (FIG. 4A).

Having described our invention other and additional preferred embodiments will become apparent to those skilled in the art to which it pertains, and without deviating from the scope of the appended claim.

We claim:

1. A telescopic charging handle incorporated into an upper receiver of an AR-15 firearm, comprising:

a first stem portion integrally formed with a handle shaped head;

a second stem portion terminating at a distal end in a projecting beak and further being telescopically engaged at a proximal end to said first stem portion; and said second stem portion further having a reduced dimension portion which is sized to seat within a communicating distal and interiorly open end of said first stem portion, a distal end located and widthwise extending aperture in said second stem portion which aligns with slots in said first stem portion and, upon insertion of a widthwise pin, is telescopically mounted between the fully collapsed and extended positions;

said charging handle extending upon being rearwardly displaced in order to accommodate a modified length sub caliber action.

2. The handle as described in claim 1, wherein said slots comprise a pair of linear slots extending a given distance along said first stem portion.

3. The handle as described in claim 1, said beak associated with said second stem portion further comprising an underside extending and sub caliber action engaging beak.

4. The handle as described in claim 1, further comprising a pair of wing projections extending in opposite fashion from a distal end of said second stem portion.

5. A charging handle incorporated into an upper receiver of an AR-15 firearm, comprising:

a stem integrally formed with a handle shaped head; and a reduced profile recess configured along said stem for preventing jamming of spent shell casings;

said stem further including a first stem portion integrally formed with a handle shaped head and a second stem portion terminating at a distal end in a projecting beak and further being telescopically engaged at a proximal end to said first stem portion;

said charging handle extending upon being rearwardly displaced in order to accommodate a modified length sub caliber action;

said second stem portion further comprising a reduced dimension portion which is sized to seat within a communicating distal and interiorly open end of said first stem portion; and a distal end located and widthwise extending aperture in said second stem portion which aligns with slots in said first stem portion and, upon insertion of a widthwise pin, is telescopically mounted between the fully collapsed and extended positions.

6. The handle as described in claim 5, wherein said slots comprise a pair of linear slots extending a given distance along said first stem portion.

7. The handle as described in claim 5, said beak associated with said second stem portion further comprising an underside extending and sub caliber action engaging beak.

8. The handle as described in claim 5, further comprising a pair of wing projections extending in opposite fashion from a distal end of said second stem portion.

9. A telescopic charging handle incorporated into an upper receiver of an AR-15 firearm, comprising:

a first stem portion integrally formed with a handle shaped head;

a pair of linear extending slots extending a given distance along said first stem portion;

a second stem portion terminating at a distal end in a projecting beak, said second stem portion having a reduced dimension and extending portion which is sized to seat within a communicating distal and interiorly open end of said first stem portion for telescopically inter-engaging said first and second stem portions between collapsed and lengthwise extended positions;

a distal located and widthwise extending aperture in said second stem portion which aligns with said slots in said first stem portion, a widthwise pin inserting through said aperture for establishing a lengthwise extensible range along said aligning slots; and said charging handle extending upon being rearwardly displaced in order to accommodate a modified length sub caliber action.

10. The handle as described in claim 9, said beak associated with said second stem portion further comprising an underside extending and sub caliber action engaging beak.

11. The handle as described in claim 9, further comprising a pair of wing projections extending in opposite fashion from a distal end of said second stem portion.

* * * * *